US011205369B2

(12) United States Patent
Yang et al.

(10) Patent No.: US 11,205,369 B2
(45) Date of Patent: Dec. 21, 2021

(54) SCREEN DISPLAY METHOD AND APPARATUS, AND METHOD AND APPARATUS FOR GENERATING GRAYSCALE MAPPING INFORMATION

(71) Applicant: BEIJING XIAOMI MOBILE SOFTWARE CO., LTD., Beijing (CN)

(72) Inventors: Kai Yang, Beijing (CN); Dong Zhai, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/099,960

(22) Filed: Nov. 17, 2020

(65) Prior Publication Data

US 2021/0304658 A1 Sep. 30, 2021

(30) Foreign Application Priority Data

Mar. 25, 2020 (CN) ..... 202010218056.X

(51) Int. Cl.
*G09G 3/3225* (2016.01)
*G09G 3/20* (2006.01)

(52) U.S. Cl.
CPC ..... *G09G 3/2007* (2013.01); *G09G 3/3225* (2013.01); *G09G 2320/0233* (2013.01)

(58) Field of Classification Search
CPC ..... G09G 3/2007; G09G 3/3225; G09G 2320/0233
See application file for complete search history.

(56) References Cited

U.S. PATENT DOCUMENTS 6,507,667 B1 * 1/2003 Hsieh ..... H04N 1/6075 348/223.1
10,706,779 B2 * 7/2020 Furihata ..... G09G 3/3291
2003/0144592 A1 * 7/2003 Jeong ..... A61B 5/4872 600/438
2006/0034487 A1 * 2/2006 Franz ..... H04N 13/239 382/104
2006/0146005 A1 * 7/2006 Baba ..... G09G 3/3233 345/102
2008/0266236 A1 * 10/2008 Shen ..... G09G 3/3406 345/102
2008/0272999 A1 * 11/2008 Kurokawa ..... G09G 3/3611 345/89
2009/0052774 A1 2/2009 Yoshii et al.
(Continued)

OTHER PUBLICATIONS

Extended European Search Report in Application No. 20210524.3 dated May 27, 2021.

*Primary Examiner* — Jose R Soto Lopez
(74) *Attorney, Agent, or Firm* — Syncoda LLC; Feng Ma

(57) ABSTRACT

A display method for generating grayscale mapping information can be applied to a terminal device, and include: determining an Open Pixel Ratio (OPR) corresponding to an image to be displayed; acquiring a preset corresponding relationship between an original grayscale value and a target grayscale value under the OPR; sequentially converting the original grayscale value corresponding to each pixel of the image to be displayed into the corresponding target grayscale value according to the corresponding relationship; and displaying the image to be displayed according to the target grayscale value corresponding to each pixel obtained by the conversion.

16 Claims, 6 Drawing Sheets

(56) References Cited

U.S. PATENT DOCUMENTS

2009/0225105 A1* 9/2009 Park ..... G09G 3/3688 345/690
2011/0051053 A1* 3/2011 Okamura ..... B29D 11/00326 349/96
2011/0149165 A1* 6/2011 Tsuchiya ..... G09G 3/3648 348/624
2013/0342585 A1* 12/2013 Chun ..... G09G 3/3208 345/690
2014/0240305 A1* 8/2014 Chae ..... G09G 3/3225 345/212
2014/0285533 A1* 9/2014 Chun ..... G09G 3/3208 345/690
2015/0187094 A1* 7/2015 Lee ..... G06T 5/009 345/590
2015/0213781 A1* 7/2015 Huang ..... G09G 5/06 345/207
2015/0302788 A1* 10/2015 Kim ..... G09G 3/2007 345/690
2015/0364076 A1* 12/2015 Park ..... G09G 3/2081 345/77
2016/0019838 A1* 1/2016 Park ..... G09G 3/3275 345/690
2016/0104408 A1* 4/2016 Kim ..... G09G 3/36 345/690
2016/0108257 A1* 4/2016 Schlechte ..... B05D 3/12 427/290
2016/0118022 A1* 4/2016 Chun ..... G09G 3/3225 345/690
2016/0171939 A1* 6/2016 Na ..... G09G 3/2003 345/690
2016/0189619 A1* 6/2016 Park ..... G09G 3/3233 345/690
2016/0267876 A1* 9/2016 Kim ..... G09G 5/10
2016/0379583 A1* 12/2016 Onishi ..... G09G 3/3618 345/691
2016/0379584 A1* 12/2016 Onishi ..... G09G 3/2025 345/691
2017/0084242 A1* 3/2017 Kang ..... G09G 3/3685
2017/0092189 A1* 3/2017 Hwang ..... G09G 3/3233
2017/0110044 A1* 4/2017 Ahn ..... G09G 3/2003
2017/0162094 A1* 6/2017 Jee ..... G09G 3/3266
2017/0193880 A1* 7/2017 Lee ..... G09G 3/2003
2017/0221404 A1* 8/2017 Park ..... G09G 3/2092
2017/0249890 A1* 8/2017 Yoo ..... G09G 3/2074
2017/0294156 A1* 10/2017 Pyo ..... G09G 3/3233
2018/0020069 A1* 1/2018 Wu ..... G06F 16/7867
2018/0047368 A1* 2/2018 Luo ..... G09G 5/10
2018/0061307 A1* 3/2018 Inoue ..... H03F 3/45475
2018/0090082 A1* 3/2018 Zhang ..... G09G 3/3607
2018/0204522 A1* 7/2018 Furihata ..... G09G 3/3275
2018/0270400 A1* 9/2018 Koh ..... G09G 3/003
2019/0043417 A1* 2/2019 Choe ..... G09G 3/3607
2019/0096362 A1* 3/2019 Wang ..... G09G 5/028
2019/0114963 A1* 4/2019 Choi ..... G09G 3/2074
2019/0147810 A1* 5/2019 Chen ..... G09G 3/3677 345/690
2019/0156772 A1* 5/2019 Yabuki ..... G09G 3/20
2019/0156786 A1* 5/2019 Aogaki ..... G09G 3/2007
2019/0180695 A1* 6/2019 Ha ..... G09G 3/3266
2019/0266941 A1* 8/2019 Pyo ..... G06T 7/90
2020/0066215 A1* 2/2020 Koo ..... G09G 3/3607
2020/0126497 A1* 4/2020 Wang ..... G09G 3/006
2020/0265788 A1* 8/2020 Kim ..... G09G 3/2003
2020/0365071 A1* 11/2020 Jeong ..... G09G 3/2007
2020/0388206 A1* 12/2020 Bae ..... G09G 3/2003
2020/0394980 A1* 12/2020 Furihata ..... G09G 3/2092
2021/0049966 A1* 2/2021 Hsu ..... G09G 3/3258
2021/0097920 A1* 4/2021 Yu ..... G09G 3/2007

* cited by examiner

SCREEN DISPLAY METHOD AND APPARATUS, AND METHOD AND APPARATUS FOR GENERATING GRAYSCALE MAPPING INFORMATION

CROSS-REFERENCE TO RELATED APPLICATIONS

This application claims the priority to Chinese Patent Application No. 202010218056.X filed Mar. 25, 2020, the disclosure of which is hereby incorporated by reference in its entirety.

BACKGROUND

In an active-matrix organic light-emitting diode (AMOLED) display, a Gamma correction is a method for editing the Gamma curve of the display screen and non-linearly editing the brightness of the display screen by adjusting the grayscale voltage, where the Gamma curve is a relationship curve between the grayscale voltage and the corresponding brightness.

SUMMARY

The present disclosure relates generally to display processing technologies, and more specifically to a screen display method and apparatus, and a method and apparatus for generating grayscale mapping information.

According to a first aspect of the embodiments of the present disclosure, there is provided a screen display method, which is applied to a terminal device and includes:

determining an Open Pixel Ratio (OPR) corresponding to an image to be displayed;

acquiring a preset corresponding relationship between an original grayscale value and a target grayscale value under the OPR;

sequentially converting the original grayscale value corresponding to each pixel of the image to be displayed into the corresponding target grayscale value according to the corresponding relationship; and displaying the image to be displayed according to the target grayscale value corresponding to each pixel obtained by the conversion.

According to a second aspect of the embodiments of the present disclosure, there is provided a method for generating grayscale mapping information for screen display, the screen display adopts the above screen display method, and the method for generating grayscale mapping information includes:

determining first grayscale corresponding relationships of a display screen under various Open Pixel Ratios (OPRs), wherein the first grayscale corresponding relationship under the OPR represents a corresponding relationship between each original grayscale value and an original gamma value under the OPR;

converting the first grayscale corresponding relationships under various OPRs into second grayscale corresponding relationships respectively according to a preset corresponding relationship between a target gamma value and each original grayscale value, wherein the second grayscale corresponding relationship under the OPR represents a corresponding relationship between the target gamma value and the target grayscale value under the OPR; and generating the corresponding relationships between the original grayscale value and the target grayscale value under various OPRs according to the original grayscale values in the first grayscale corresponding relationships and the target grayscale values in the second grayscale corresponding relationships under various OPRs.

According to a third aspect of the embodiments of the present disclosure, there is provided a screen display apparatus, including:

a determination module, configured to determine an Open Pixel Ratio (OPR) corresponding to an image to be displayed;

an acquisition module, configured to acquire a preset corresponding relationship between an original grayscale value and a target grayscale value under the OPR;

a conversion module, configured to sequentially convert the original grayscale value corresponding to each pixel of the image to be displayed into the corresponding target grayscale value according to the corresponding relationship; and a display module, configured to display the image to be displayed according to the target grayscale value corresponding to each pixel obtained by the conversion.

According to a fourth aspect of the embodiments of the present disclosure, there is provided an apparatus for generating grayscale mapping information for screen display, including:

a determining module, configured to determine first grayscale corresponding relationships of a display screen under various Open Pixel Ratios (OPRs), wherein the first grayscale corresponding relationship under the OPR represents a corresponding relationship between each original grayscale value and an original gamma value under the OPR;

a conversion module, configured to convert the first grayscale corresponding relationships under various OPRs into second grayscale corresponding relationships respectively according to a preset corresponding relationship between a target gamma value and each original grayscale value, wherein the second grayscale corresponding relationship under the OPR represents a corresponding relationship between the target gamma value and the target grayscale value under the OPR; and a generating module, configured to generate the corresponding relationships between the original grayscale value and the target grayscale under various OPRs according to the original grayscale values in the first grayscale corresponding relationships and the target grayscale values in the second grayscale corresponding relationships under various OPRs.

According to a fifth aspect of the embodiments of the present disclosure, there is provided a screen display apparatus, including:

a processor; and memory for storing instructions executable by the processor;

wherein the processor is configured to:

determine an Open Pixel Ratio (OPR) corresponding to an image to be displayed;

acquire a preset corresponding relationship between an original grayscale value and a target grayscale value under the OPR;

sequentially convert the original grayscale value corresponding to each pixel of the image to be displayed into the corresponding target grayscale value according to the corresponding relationship; and display the image to be displayed according to the target grayscale value corresponding to each pixel obtained by the conversion.

According to a sixth aspect of the embodiments of the present disclosure, there is provided an apparatus for generating grayscale mapping information for screen display, including:

a processor; and memory for storing instructions executable by the processor;

wherein the processor is configured to:

determine first grayscale corresponding relationships of a display screen under various Open Pixel Ratios (OPRs), wherein the first grayscale corresponding relationship under the OPR represents a corresponding relationship between each original grayscale value and an original gamma value under the OPR;

convert the first grayscale corresponding relationships under various OPRs into second grayscale corresponding relationships respectively according to a preset corresponding relationship between a target gamma value and each original grayscale value, wherein the second grayscale corresponding relationship under the OPR represents a corresponding relationship between the target gamma value and the target grayscale value under the OPR; and generate the corresponding relationships between the original grayscale value and the target grayscale value under various OPRs according to the original grayscale values in the first grayscale corresponding relationships and the target grayscale values in the second grayscale corresponding relationships under various OPRs.

According to a seventh aspect of the embodiments of the present disclosure, there is provided a non-transitory computer-readable storage medium, when instructions in the storage medium are executed by a processor of a terminal device, enabling the terminal device to perform a screen display method, the method including:

determining an Open Pixel Ratio (OPR) corresponding to an image to be displayed;

acquiring a preset corresponding relationship between an original grayscale value and a target grayscale value under the OPR;

sequentially converting the original grayscale value corresponding to each pixel of the image to be displayed into the corresponding target grayscale value according to the corresponding relationship; and displaying the image to be displayed according to the target grayscale value corresponding to each pixel obtained by the conversion.

According to an eighth aspect of the embodiments of the present disclosure, there is provided a non-transitory computer-readable storage medium, when instructions in the storage medium are executed by a processor of a terminal device, enabling the terminal device to execute a method for generating grayscale mapping information for screen display, the method including:

determining first grayscale corresponding relationships of a display screen under various Open Pixel Ratios (OPRs), wherein the first grayscale corresponding relationship under the OPR represents a corresponding relationship between each original grayscale value and an original gamma value under the OPR;

converting the first grayscale corresponding relationships under various OPRs into second grayscale corresponding relationships respectively according to a preset corresponding relationship between a target gamma value and each original grayscale value, wherein the second grayscale corresponding relationship under the OPR represents a corresponding relationship between the target gamma value and the target grayscale value under the OPR; and generating the corresponding relationships between the original grayscale value and the target grayscale value under various OPRs according to the original grayscale values in the first grayscale corresponding relationships and the target grayscale values in the second grayscale corresponding relationships under various OPRs.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this disclosure, illustrate embodiments consistent with the present disclosure and, together with the description, serve to explain the principles of the present disclosure.

DETAILED DESCRIPTION

Reference will now be made in detail to some embodiments, examples of which are illustrated in the accompanying drawings. The following description refers to the accompanying drawings in which the same numbers in different drawings represent the same or similar elements unless otherwise represented. The implementations set forth in the following description of some embodiments do not represent all implementations consistent with the present disclosure. Instead, they are merely examples of apparatuses and methods consistent with aspects related to the present disclosure as recited in the appended claims.

A standard Gamma value of a display screen can be 2.2, and the Gamma value in the case of picture distortion deviates from 2.2. The inventors of the present disclosure have recognized that an accurate Gamma value of the display screen is essential for displaying color.

An AMOLED display can lead to effects of fatigue on human eyes, which is caused by very complicated factors, among which high contrast is a factor. The high contrast is caused by the gamma output of each pixel is not 2.2. Therefore, it needs to display according to the international standard, that is, the gamma needs to be 2.2. It is found that due to the IR-drop (IR pressure drop) phenomenon of the display screen, the gamma value will change with the change of the pixel display ratio OPR (that is, a percentage of the displayed image to the display screen) corresponding to the image to be displayed, that is, under different OPRs, the output gamma will deviate from the standard value of 2.2.

For example, when the pixel display ratio OPR corresponding to the image to be displayed (that is, the percentage of the displayed image in the display screen) reaches the maximum brightness of the space of 100%, the display screen can display the image according to the standard gamma value (e.g., 2.2). When the pixel display ratio OPR corresponding to the image to be displayed is less than the maximum brightness of space of 100%, the actual control gamma value is not the standard gamma value, but is far from the standard gamma value.

Accordingly, various embodiments of the present application provide a screen display method and apparatus, and a method and apparatus for generating grayscale mapping information with respect to the above problems.

Figure 1:
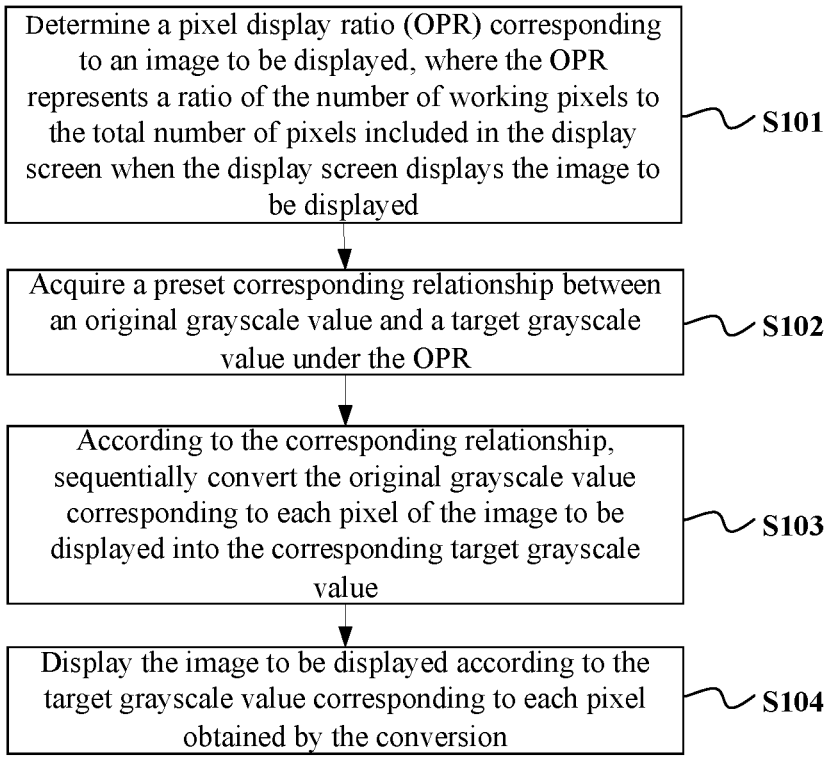
FIG. 1 is a flowchart showing a method for screen display according to some embodiments.

FIG. 1 is a flowchart showing a method for displaying a screen according to some embodiments. This method may be applied to a terminal device, and as shown in FIG. 1, the method includes the following operations.

In step S101, an OPR corresponding to an image to be displayed is determined, where the OPR represents a ratio of the number of working pixels to the total number of pixels included in the display screen when the display screen displays the image to be displayed.

In step S102, a preset corresponding relationship between an original grayscale value and a target grayscale value under the OPR is acquired.

In step S103, according to the corresponding relationship, the original grayscale value corresponding to each pixel of the image to be displayed is sequentially converted into the corresponding target grayscale value.

In step S104, the image to be displayed is displayed according to the target grayscale value corresponding to each pixel obtained by the conversion.

In this embodiment, the OPR corresponding to the image to be displayed indicates the proportion of the number of working pixels in the total number of pixels included in the display screen when the display screen displays the image to be displayed, where the working pixels may be regarded as the lit pixels and non-working pixels may be regarded as unlit pixels. Therefore, the OPR corresponding to the image to be displayed can indicate the display brightness of the display screen when the mobile terminal displays the image. As the images to be displayed are different, the corresponding OPRs are also different. Therefore, as the image to be displayed changes, the display brightness of the display screen also changes.

The preset corresponding relationship between the original grayscale value and the target grayscale value under the determined OPR is mainly used to convert the grayscale value of the image to be displayed under the OPR. This is because, when displaying according to the original grayscale value of the image to be displayed under the current OPR, there is a difference between the actual display brightness of the screen and the preset brightness effect. That is, the display brightness effect achieved by the actual gamma value corresponding to the display screen is different from the display brightness effect achieved by the preset gamma value. Therefore, in this embodiment, the original grayscale value of the image to be displayed is changed according to the preset corresponding relationship, so as to control the brightness of the display screen to achieve the preset brightness value effect. The preset brightness value may be set according to different scenarios and different needs of users. For example, the preset brightness value may be the international standard gamma2.2, or other gamma values with high contrast effects (for example, the preset value of the specific color enhancement effect is gamma2.4).

As can be seen from the above, in the present disclosure, it is considered that a change in the gamma value may occur due to different OPRs of the displayed images of the display screen, and then the image displayed on the display screen has the effect of flickering. Therefore, in this embodiment, the corresponding relationship between the original grayscale value and the target grayscale value under the OPR corresponding to the current image to be displayed is obtained in real time, and the grayscale of the image to be displayed is adjusted, so that the display brightness effect of the display screen of the mobile terminal under the current OPR keeps the same as the preset display brightness effect. It can be seen that, in this embodiment, without adding any hardware to compensate, the display screen can achieve the effect of displaying the image according to the expected gamma output under any circumstances, ensure the consistency of the image brightness effect displayed on the display screen, and improve the user experience.

This embodiment also provides a screen display method. In this method, determining the OPR corresponding to the image to be displayed includes:

detecting a grayscale value of each pixel in the image to be displayed;

calculating an average grayscale value of the image to be displayed according to the grayscale value of each pixel in the image to be displayed; and according to the average grayscale value of the image to be displayed, determining the OPR corresponding to the image to be displayed.

The grayscale value of each pixel in the image to be displayed may be detected by the hardware (such as the processor of the mobile terminal) or software (such as an application with color processing installed on the mobile terminal) of the mobile terminal.

The average grayscale value of the image to be displayed reflects the brightness change of the brightest part and the darkest part of the entire image to be displayed. For example, the sum of the grayscale values of all pixels in the image to be displayed may be calculated according to the grayscale value of each pixel in the image to be displayed. According to the number of pixels in the image to be displayed, the average grayscale value of the image to be displayed is calculated.

The OPR corresponding to the image to be displayed is the ratio of the average grayscale value of the displayed image to the maximum grayscale value of the current screen, that is, when displaying the image, the ratio of the number of pixels that need to be lit (that is, the number of working pixels) in the total number of the pixels included in the entire display screen. Taking the pure white 255 grayscale interface as an example, the average grayscale value of an image to be displayed in a certain frame is 225, then the OPR corresponding to the image to be displayed is 225/255. Taking the 1024 grayscale interface as an example, the average grayscale value of an image to be displayed in a certain frame is 980, then the OPR corresponding to the image to be displayed is 980/1024.

It can be seen that this embodiment provides a specific implementation manner for determining the OPR corresponding to the image to be displayed. Based on this manner, after determining the OPR corresponding to the image to be displayed, the corresponding relationship between the original grayscale value and the target grayscale value under the current OPR may be obtained, the grayscale of the image to be displayed is adjusted and then the image is displayed, thereby ensuring that the display screen can output the displayed image according to the expected display brightness under any circumstances.

This embodiment also provides a screen display method. In this method, calculating the average grayscale value of the image to be displayed includes:

acquiring a color histogram of the image to be displayed by using a color engine in the mobile terminal; and calculating the average grayscale value of the image to be displayed according to a distribution of the color histogram.

The color engine is mainly used to convert the image to be displayed into a corresponding color histogram, and the color histogram may represent the color characteristics of the image to be displayed. The color engine may be a color engine module in the mobile terminal, or may be a third-party color processing application installed on the mobile terminal.

There are many ways to calculate the average grayscale value of the image to be displayed according to the distribution of the color histogram. For example, according to the distribution of the color histogram, the lightness and darkness of the entire image to be displayed may be obtained, thereby calculating the average grayscale value of the image to be displayed.

This embodiment calculates the average grayscale value of the image to be displayed by using the existing respective functional applications of the mobile terminal, which achieves the effect of using resources reasonably and improves the processing efficiency of the entire screen display.

This embodiment also provides a screen display method. In this method, acquiring the preset corresponding relationship between the original grayscale value and the target grayscale value under the OPR includes:

from third-party data information, acquire the preset corresponding relationship between the original grayscale value and the target grayscale value when the display screen of the mobile terminal is under the OPR; or from a set storage location of the mobile terminal, acquire the preset corresponding relationship between the original grayscale value and the target grayscale value when the display screen of the mobile terminal is under the OPR.

The third-party data information includes various databases and data platforms that provide characteristic and attribute parameters of the display screen. This is because, when the display screen is at the OPR, the preset corresponding relationship between the original grayscale value and the target grayscale value is used to convert the grayscale value of the image to be displayed under the OPR, thereby controlling the brightness of the display screen to reach the preset brightness value effect. It can be seen that when the display screen is at the OPR, the preset corresponding relationship between the original grayscale value and the target grayscale value is related to the characteristics of the display screen. Therefore, it can be obtained from the third-party data information used to provide the characteristics and attribute parameters of the display screen.

The set storage location of the mobile terminal may include a display configuration file of the mobile terminal, a system configuration file of the mobile terminal, and the like. That is to say, the mobile terminal is pre-configured with the corresponding relationships between the original grayscale value and the target grayscale value of the display screen under various OPRs. After determining the pixel display ratio OPR corresponding to the image to be displayed, it is only necessary to query the preset corresponding relationship between the original grayscale value and the target grayscale value under the current OPR from the preset corresponding relationships between the original grayscale value and the target grayscale value under various OPRs stored in the set storage location of the mobile terminal.

Figure 2:
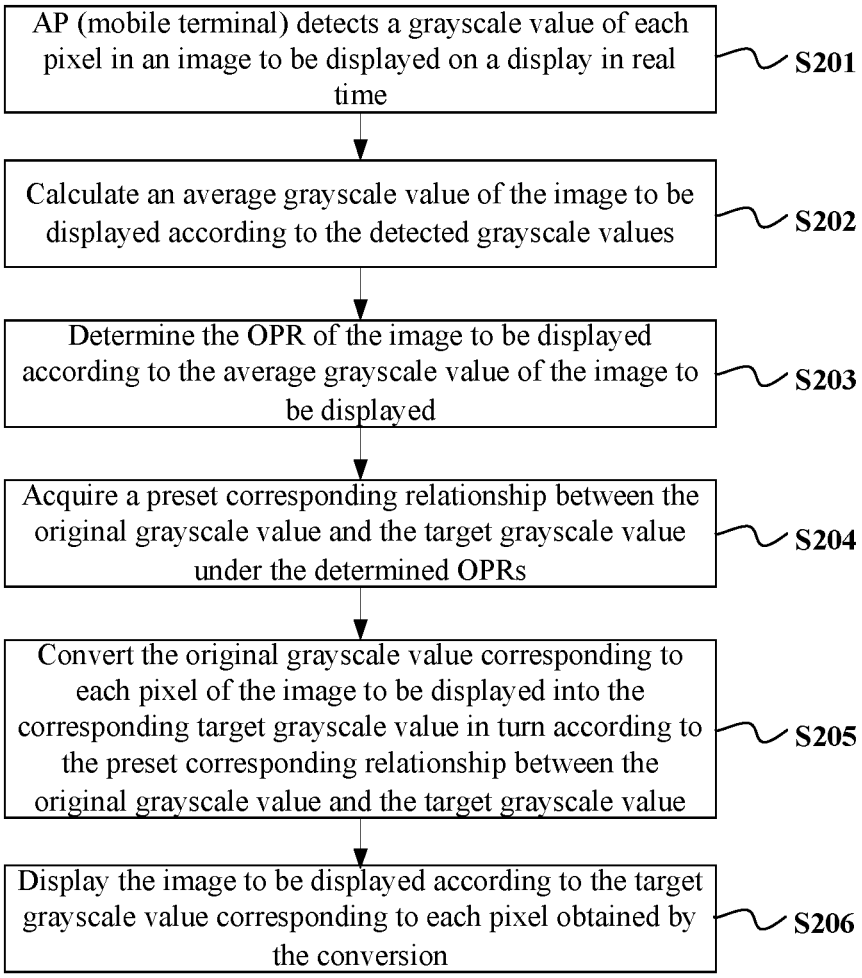
FIG. 2 is a flowchart showing a method for screen display according to some embodiments.

FIG. 2 is a flowchart of a screen display method provided by some embodiments. As shown in FIG. 2, the method includes the following steps.

In step S201, an AP (mobile terminal) detects a grayscale value of each pixel in an image to be displayed on a display in real time.

In step S202, an average grayscale value of the image to be displayed is calculated according to the detected grayscale values.

A color engine in the mobile terminal may be used to obtain the color histogram of the image to be displayed, and the average grayscale value of the image to be displayed may be calculated according to a distribution of the color histogram.

In step S203, the OPR corresponding to the image to be displayed (that is, the ratio of the displayed image to the screen) is determined according to the average grayscale value of the image to be displayed.

Taking the pure white 255 grayscale interface as an example, assuming that the calculated average grayscale value of the image to be displayed is 128, then the OPR of the image to be displayed is 128/255.

In step S204, a preset corresponding relationship between the original grayscale value and the target grayscale value under the determined OPR is acquired.

In the above steps, there are many ways to acquire the preset corresponding relationship between the original grayscale value and the target grayscale value. For example, it may be obtained by remotely accessing third-party data information used to provide characteristic and attribute parameters of the display screen, or it may be obtained from the configuration file of the mobile terminal.

In step S205, the original grayscale value corresponding to each pixel of the image to be displayed is converted into the corresponding target grayscale value according to the preset corresponding relationship between the original grayscale value and the target grayscale value.

In step S206, the image to be displayed is displayed according to the target grayscale value corresponding to each pixel obtained by the conversion.

This embodiment ensures that under different OPRs, by adjusting the grayscale value of the image to be displayed, the brightness effects of the display screen can achieve the effects corresponding to the preset brightness values. That is, under any OPR, the brightness effect of the image displayed on the display screen is the same.

Figure 3:
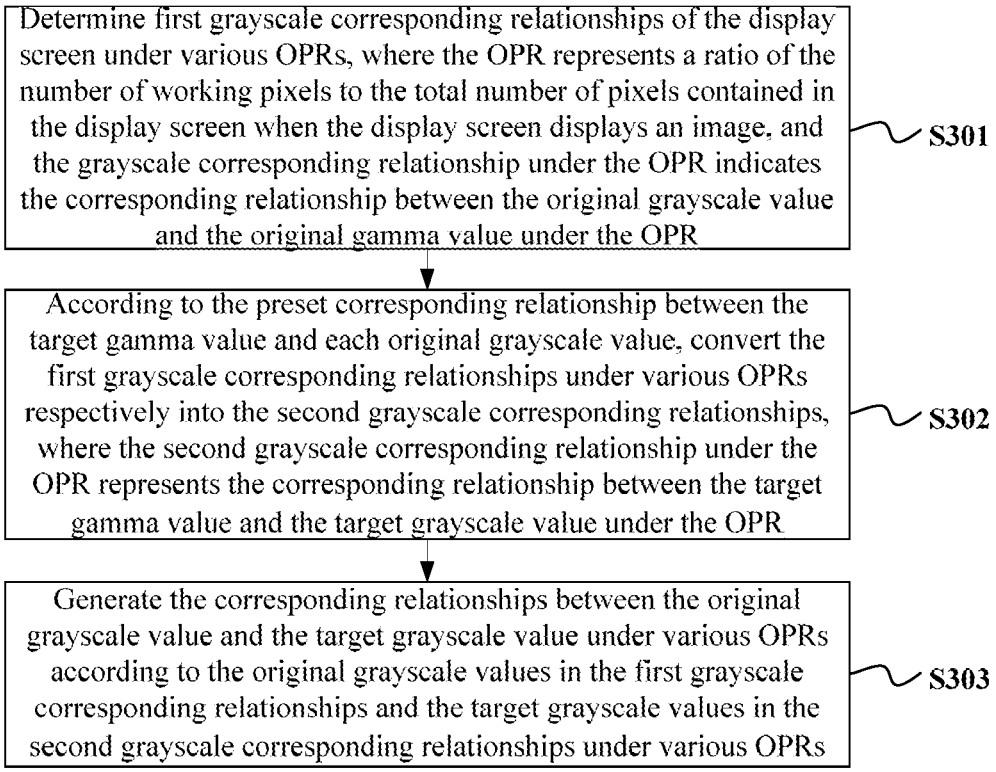
FIG. 3 is a flowchart showing a method for generating grayscale mapping information for screen display according to some embodiments.

FIG. 3 is a flowchart showing a method for generating grayscale mapping information for screen display according to some embodiments. The method is shown in FIG. 3 and includes the following operations.

In step S301, first grayscale corresponding relationships of the display screen under various OPRs are determined, where the OPR represents a ratio of the number of working pixels to the total number of pixels contained in the display screen when the display screen displays an image, and the grayscale corresponding relationship under the OPR indicates the corresponding relationship between each original grayscale value and an original gamma value under the OPR.

In step S302, according to the preset corresponding relationship between the target gamma value and each original grayscale value (i.e., the current actual grayscale value), the first grayscale corresponding relationships under various OPRs are respectively converted into second grayscale corresponding relationships, where the second grayscale corresponding relationship under the OPR represents the corresponding relationship between a target gamma value and a target grayscale value under the OPR.

In step S303, the corresponding relationships between the original grayscale value and the target grayscale value under various OPRs are generated according to the original grayscale values in the first grayscale corresponding relationships and the target grayscale values in the second grayscale corresponding relationships under various OPRs.

In step S301, the first grayscale corresponding relationship under OPR represents the corresponding relationship between each original grayscale value and the original gamma value under the OPR, that is, the corresponding relationship between each original grayscale value and the actual output gamma value under the OPR after the gamma value is set by the hardware of the mobile terminal. The corresponding first grayscale corresponding relationships under various OPRs are determined after the hardware is configured, that is, they are related to the characteristics of the hardware (that is, the display screen), that is, the first grayscale corresponding relationships of different display screens under various OPRs may be different. Therefore, it is necessary to determine the first grayscale corresponding relationships of the display screen under various OPRs. In this embodiment, there may be multiple ways to determine the first grayscale corresponding relationships of the display screen under various OPRs. For example, the first grayscale corresponding relationship corresponding to the OPR may be obtained by detecting the display screen of the mobile terminal. For another example, the first grayscale corresponding relationship corresponding to the OPR may be obtained from the relevant parameter information of the display screen provided by the third-party data platform.

When determining the first grayscale corresponding relationships corresponding to various OPRs, various OPRs include multiple OPRs related to the maximum grayscale. Taking the pure white 255 grayscale interface as an example, the OPR may include 255 types, namely 1/255, 2/255, 3/255, . . . 244/255, 255/255, at this time, the first grayscale corresponding relationships corresponding to 255 types of OPRs may be determined. Taking the 1024 grayscale interface as an example, there may be 1024 types of OPRs, and at this time, the first grayscale corresponding relationships corresponding to the 1024 types of OPRs may be determined.

In step S302, when converting the first grayscale corresponding relationships under various OPRs into the second grayscale corresponding relationships, the second grayscale corresponding relationships under various OPRs are obtained by adjusting the values of the grayscale and gamma in the first grayscale corresponding relationships under the various OPRs based on the preset corresponding relationship between the target gamma value and each original grayscale value. The values of the gamma in the second grayscale corresponding relationships under various OPRs are infinitely close to the target gamma value.

In the present disclosure, there may be multiple ways to convert the first grayscale corresponding relationships under various OPRs into the second grayscale corresponding relationships. For example, according to the preset corresponding relationship between the standard gamma value and the grayscale value, the original gamma values in the first grayscale corresponding relationships are first adjusted to the standard gamma values respectively, at this time, the adjustment range corresponding to the original grayscale value may be determined when adjusting the original gamma value to the standard gamma value. According to the original grayscale value and the adjustment range corresponding to the original grayscale value, the target grayscale value corresponding to the original grayscale value may be calculated. In this way, according to the target grayscale value corresponding to each original grayscale value in the first grayscale corresponding relationship and the target gamma value, the second grayscale corresponding relationship is obtained.

The preset corresponding relationship between the target gamma value and each original grayscale value indicates the corresponding relationship between the target gamma value and each original grayscale value under the set OPR, that is, under the set OPR, the output gamma value corresponding to each original grayscale value is the target gamma value. In general, the OPR may be set to 100%, and the target gamma value may be the international standard gamma2.2, or other gamma values with high contrast effects (for example, the preset value of specific color enhancement effect is gamma2.4). That is, based on the reason that the gamma value directly affects the contrast of the AMOLED, the target gamma value may be set according to different scenarios and different needs of users.

When generating the corresponding relationships between the original grayscale value and the target grayscale value under various OPRs, the original grayscale value corresponding to the original gamma value in the first grayscale corresponding relationship when the original gamma values in the first grayscale corresponding relationships under various OPRs are adjusted to the target gamma values in the second grayscale corresponding relationships and the corresponding target grayscale value in the second grayscale corresponding relationship when the original gamma value is adjusted to the target gamma value may be based on, and they have a corresponding relationship. According to this mapping method, the corresponding relationships between all the original grayscale values in the first grayscale corresponding relationships and the target grayscale values in the second grayscale corresponding relationships are sequentially determined, which are the corresponding relationships between the original grayscale value and the target grayscale value under various OPRs mentioned in the present disclosure.

In this embodiment, it is considered that the display brightness of the display screen may change due to the different OPRs of the displayed images, that is, the output gamma value changes, so that the images displayed on the display screen have the effect of flickering. Therefore, in this embodiment, the actual gamma values of the display screen under various OPRs are determined by pre-determining the corresponding relationships between the original grayscale value and the original gamma value under various OPRs. Therefore, according to the difference between the actual gamma value of the display screen under various OPRs and the target gamma value, the conversion relationships of the grayscale values under various OPRs are generated, that is, the corresponding relationship between the original grayscale value and the target grayscale value is used to convert the original grayscale value of the image to be displayed to the target grayscale value under various OPRs. Therefore, the brightness effect of the image displayed on the display screen is controlled to achieve the display effect corresponding to the target gamma value. The conversion relationships of the grayscale values under various OPRs are generated based on the preset corresponding relationship between the target gamma value and each original grayscale value. The preset corresponding relationship between the target gamma value and each original grayscale value in this embodiment may be set according to user needs. Therefore, the displayed image can achieve the color display effect required by the user and the user experience is improved.

This embodiment also provides a method for generating grayscale mapping information for screen display. In this method, the conversion of the first grayscale corresponding relationships under various OPRs to the second grayscale corresponding relationships includes:

using a preset conversion method to convert the first grayscale corresponding relationships under various OPRs to the second grayscale corresponding relationships;

where the preset conversion method includes any of the following:

a manner using a preset conversion function;

a manner for conversion according to a preset lookup table; and a manner for conversion using a preset matrix calculating function.

In this disclosure, the first grayscale corresponding relationships, the second grayscale corresponding relationships, and the preset corresponding relationships between the target gamma value and each original grayscale value under various OPRs may include multiple formats, for example, the format may be a mapping table including the corresponding relationship between the grayscale value and the gamma value under this OPR. As another example, the format may be a gamma curve, and the gamma curve is formed by the gamma value corresponding to each grayscale value under the OPR. The first grayscale corresponding relationships, the second grayscale corresponding relationships, and the preset corresponding relationship between the target gamma value and each original grayscale value may have the same or different formats.

When the preset conversion function is used, it may be applied to the scenario where the first grayscale corresponding relationship, the second grayscale corresponding relationship, and the preset corresponding relationship between the target gamma value and each original grayscale value are a curve function. That is, the corresponding relationships between each original grayscale value and the original gamma value in the first grayscale corresponding relationships under various OPRs may be characterized by the curve function. At this time, the curve function corresponding to the corresponding relationship between the target gamma value and each original grayscale value is used as the target curve function, and the gamma parameter in the curve function corresponding to the first grayscale corresponding relationship is adjusted to infinitely close to the target curve function through the preset conversion function. The adjusted curve function is considered to represent the second grayscale corresponding relationship.

When the lookup table manner or the matrix calculation manner is used, it may be applied to the scenario where the first grayscale corresponding relationship is a mapping table. That is, the corresponding relationship between each original grayscale value and the original gamma value in the first grayscale corresponding relationship under the current OPR may be directly characterized by the mapping table. At this time, through the lookup table manner or the matrix calculation manner, each original grayscale value in the mapping table corresponding to the first grayscale corresponding relationship may be converted into a corresponding target grayscale value, and the original gamma value corresponding to each original grayscale value may be converted to the target gamma value. The mapping table obtained after the conversion is regarded as the second grayscale corresponding relationship.

It can be seen that, in this embodiment, through various algorithms, the original grayscale and original gamma values under various OPRs are converted into the target grayscale and target gamma values. That is, under various OPRs, the original grayscale value may be adjusted to the target grayscale value to control the display effect of the display screen to be the expected display effect.

Figure 4:
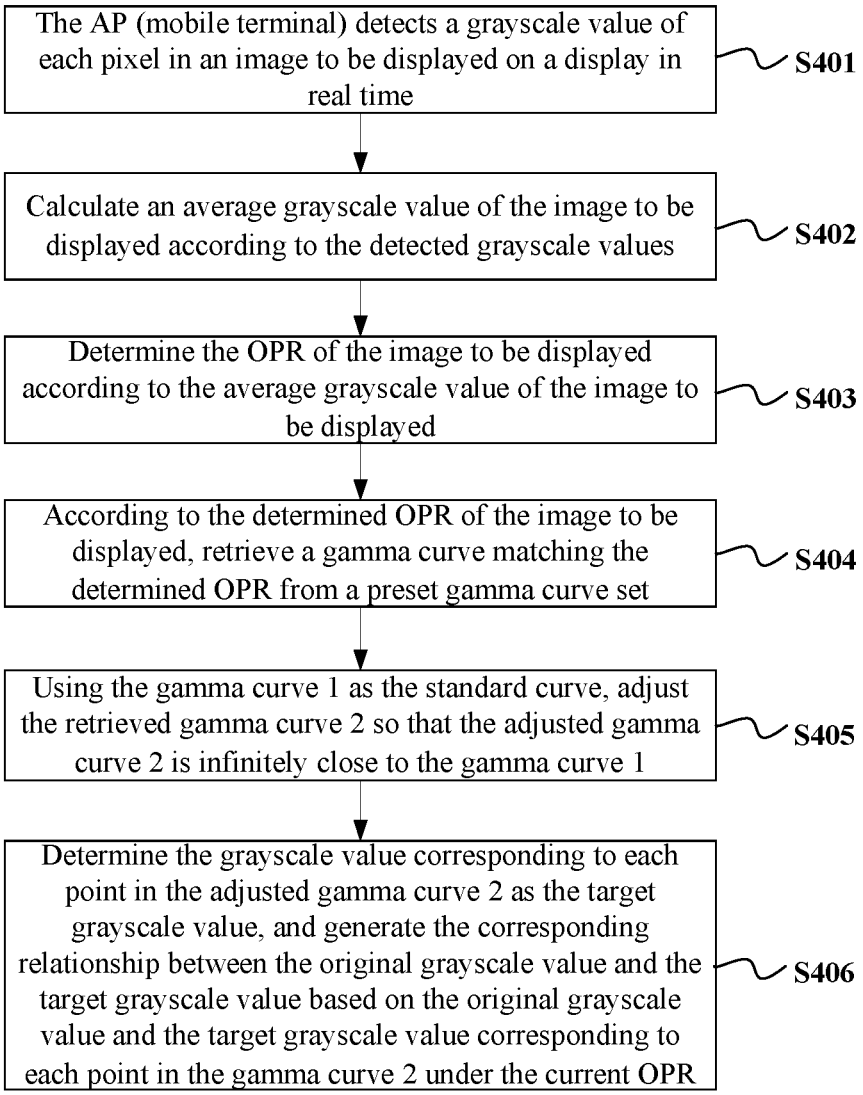
FIG. 4 is a flowchart showing a method for generating grayscale mapping information for screen display according to some embodiments.

FIG. 4 is a flowchart of a method for generating grayscale mapping information for screen display provided by some embodiments. As shown in FIG. 4, the method includes the following operation steps.

In step S401, the AP (mobile terminal) detects a grayscale value of each pixel in an image to be displayed on a display in real time.

In step S402, an average grayscale value of the image to be displayed is calculated according to the detected grayscale values.

A color engine in the mobile terminal may be used to obtain the color histogram of the image to be displayed, and the average grayscale value of the image to be displayed may be calculated according to a distribution of the color histogram.

In step S403, the OPR of the image to be displayed (that is, the ratio of the displayed image to the screen) is determined according to the average grayscale value of the image to be displayed.

Taking the pure white 255 grayscale interface as an example, assuming that the calculated average grayscale value of the image to be displayed is 128, then the OPR of the image to be displayed is 128/255.

In step S404, according to the determined OPR of the image to be displayed, a gamma curve matching the determined OPR is retrieved from a preset gamma curve set.

Figure 5:
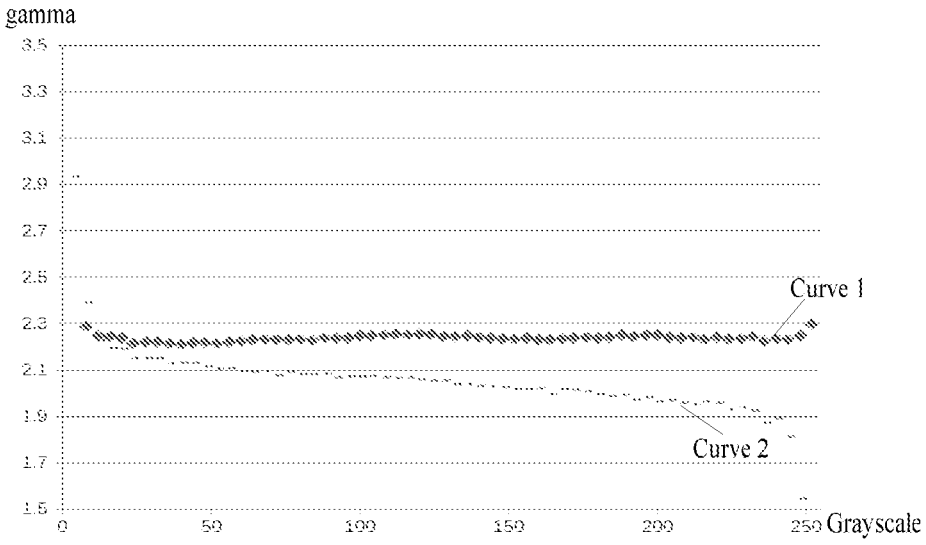
FIG. 5 is a schematic diagram showing a set of gamma curves according to some embodiments.

The preset gamma curve set includes multiple gamma curves. Each gamma curve characterizes the corresponding relationship between the original grayscale and the original gamma under an OPR. Taking the pure white 255 grayscale interface as an example, the preset gamma curve set may include N gamma curves, $0<N\leq255$. FIG. 5 is a schematic diagram of a preset gamma curve set. For ease of viewing, only two gamma curves are marked in FIG. 5 schematically. When OPR is 100%, the corresponding gamma curve is curve 1, and the gamma corresponding to each grayscale value is basically 2.2 at this time. When OPR is 20%, the corresponding gamma curve is curve 2. In curve 2, as the grayscale value increases, the gamma value becomes smaller sequentially, and the gamma value basically deviates from 2.2.

In this embodiment, it is assumed that the OPR of the image to be displayed is 128/255, that is, 20%. Therefore, the retrieved gamma curve at this time is the curve 2 shown in FIG. 5. In this embodiment, the preset brightness value is assumed to be gamma2.2. Therefore, the curve 1 shown in FIG. 5 represents the preset corresponding relationship between the standard gamma value and the grayscale value, that is, the curve 1 is determined to be the standard gamma curve. In other application scenarios, the corresponding relationship between the standard gamma value and the grayscale value may be preset according to different user preferences. Among them, the standard gamma value may not be limited to the standard 2.2.

In step S405, using the gamma curve 1 as the standard curve, the retrieved gamma curve 2 is adjusted so that the adjusted gamma curve 2 is infinitely close to the gamma curve 1.

The grayscale value of each point on the gamma curve 2 may be adjusted so that the corresponding gamma value is close to the standard gamma value (that is, 2.2) in the gamma curve 1. It can be seen from FIG. 5 that the offset of the grayscale value at different points on the gamma curve 2 from the gamma curve 1 is not a straight line and needs to be adjusted separately. It can also be adjusted by fitting a similar straight line with a slope.

In step S406, the grayscale value corresponding to each point in the adjusted gamma curve 2 is determined as the target grayscale value, and the corresponding relationship between the original grayscale value and the target grayscale value is generated based on the original grayscale value and the target grayscale value corresponding to each point in the gamma curve 2 under the current OPR.

The above process uses the OPR of 20% as an example to describe the process of generating the corresponding relationship (that is, the grayscale mapping information used for screen display when the OPR is 20%) between the original grayscale value and the target grayscale when the OPR of the display screen is 20%. In this way, the corresponding relationships between the original grayscale value and the target grayscale when the OPR of the display screen is other values may be generated separately. Finally, the corresponding relationships between the original grayscale value and the target grayscale under various OPRs of the display screen can be obtained. The corresponding relationships between the original grayscale value and the target grayscale under various OPRs of the display screen may be considered as complete grayscale mapping information for screen display.

It can be seen that in this embodiment, based on the preset corresponding relationship between the standard gamma and the grayscale value, the corresponding relationships between the original grayscale value and the target grayscale value of the display screen under different OPRs is generated. It is used to control the brightness effect of the display screen by adjusting the grayscale value of the image to be displayed to achieve the effect corresponding to the preset brightness value. That is, under any OPR, the brightness effects of the images displayed on the display screen are the same.

Figure 6:
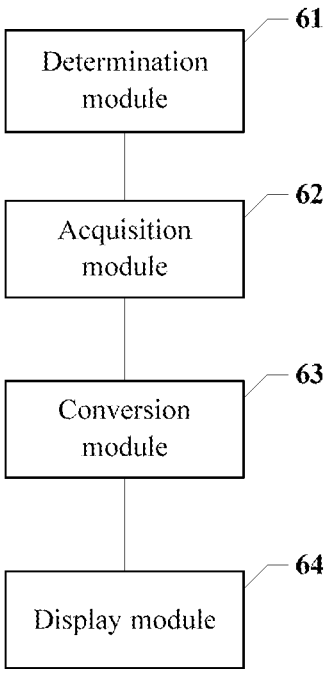
FIG. 6 is a block diagram of a screen display device according to some embodiments.

FIG. 6 is a block diagram of a screen display apparatus according to some embodiments. As shown in FIG. 6, the apparatus includes a determination module 61, an acquisition module 62, a conversion module 63 and a display module 64.

The determination module 61 is configured to determine a pixel display ratio OPR corresponding to an image to be displayed, where the OPR represents a ratio of a number of working pixels to a total number of pixels included in the display screen when the display screen displays the image to be displayed.

The acquisition module 62 is configured to acquire a preset corresponding relationship between the original grayscale value and the target grayscale value under the OPR.

The conversion module 63 is configured to sequentially convert the original grayscale value corresponding to each pixel of the image to be displayed into the corresponding target grayscale value according to the corresponding relationship.

The display module 64 is configured to display the image to be displayed according to the target grayscale value corresponding to each pixel obtained by the conversion.

This embodiment also provides a screen display apparatus, where the determination module includes:

a detection submodule, configured to detect an original grayscale value of each pixel in the image to be displayed;

a calculation submodule, configured to calculate an average grayscale value of the image to be displayed according to the original grayscale value of each pixel in the image to be displayed; and a determination submodule, configured to determine the OPR corresponding to the image to be displayed according to the average grayscale value of the image to be displayed.

This embodiment also provides a screen display apparatus, where the calculation submodule includes:

a first submodule, configured to acquire a color histogram of the image to be displayed using a color engine in the mobile terminal; and a second submodule, configured to calculate an average grayscale value of the image to be displayed according to a distribution of the color histogram.

This embodiment also provides a screen display apparatus, where the acquisition module includes:

a first acquisition submodule, configured to acquire, from third-party data information, the preset corresponding relationship between the original grayscale value and the target grayscale value when the display screen of the mobile terminal is at OPR; or a second acquisition submodule, configured to acquire, from a set storage location of the mobile terminal, the preset corresponding relationship between the original grayscale value and the target grayscale value when the display screen of the mobile terminal is at OPR.

Regarding the apparatuses in the above embodiment, the specific manner in which each module performs operations has been described in detail in the embodiments related to the method, and will not be elaborated here.

Figure 7:
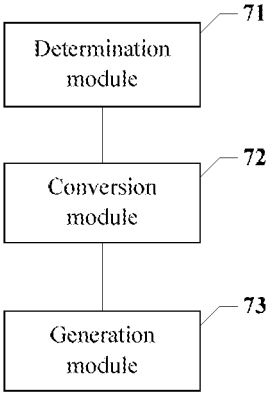
FIG. 7 is a block diagram of an apparatus for generating grayscale mapping information for screen display according to some embodiments.

FIG. 7 is a block diagram of an apparatus for generating grayscale mapping information for screen display according to some embodiments. As shown in FIG. 7, the apparatus includes a determination module 71, a conversion module 72, and a generation module 73.

The determination module 71 is configured to determine first grayscale corresponding relationships of the display screen under various OPRs, where the OPR represents a ratio of a number of working pixels to a total number of pixels included in the display screen when the display screen displays the image, and the first grayscale corresponding relationship under the OPR characterizes the corresponding relationship between each original grayscale value and the original gamma value under the OPR.

The conversion module 72 is configured to respectively convert the first grayscale corresponding relationships under various OPRs into second grayscale corresponding relationships according to the preset corresponding relationship between the target gamma value and each original grayscale value, where the second grayscale corresponding relationship under the OPR characterizes the corresponding relationship between the target gamma value and the target grayscale value under the OPR.

The generation module 73 is configured to generate the corresponding relationships between the original grayscale value and the target grayscale value under various OPRs according to the original grayscale values in the first grayscale corresponding relationships and the target grayscale values in the second grayscale corresponding relationships under various OPRs.

This embodiment also provides an apparatus for generating grayscale mapping information for screen display, where the conversion module includes:

a first submodule, configured to use a preset conversion method to convert the first grayscale corresponding relationships under various OPRs into the second grayscale corresponding relationships; and the preset conversion method includes any of the following:

a manner using a preset conversion function;

a manner for conversion according to a preset lookup table; and a manner for conversion using a preset matrix calculation function.

Regarding the apparatuses in the above embodiments, the specific manner in which each module performs operations has been described in detail in the embodiments related to the method, and will not be elaborated here.

Figure 8:
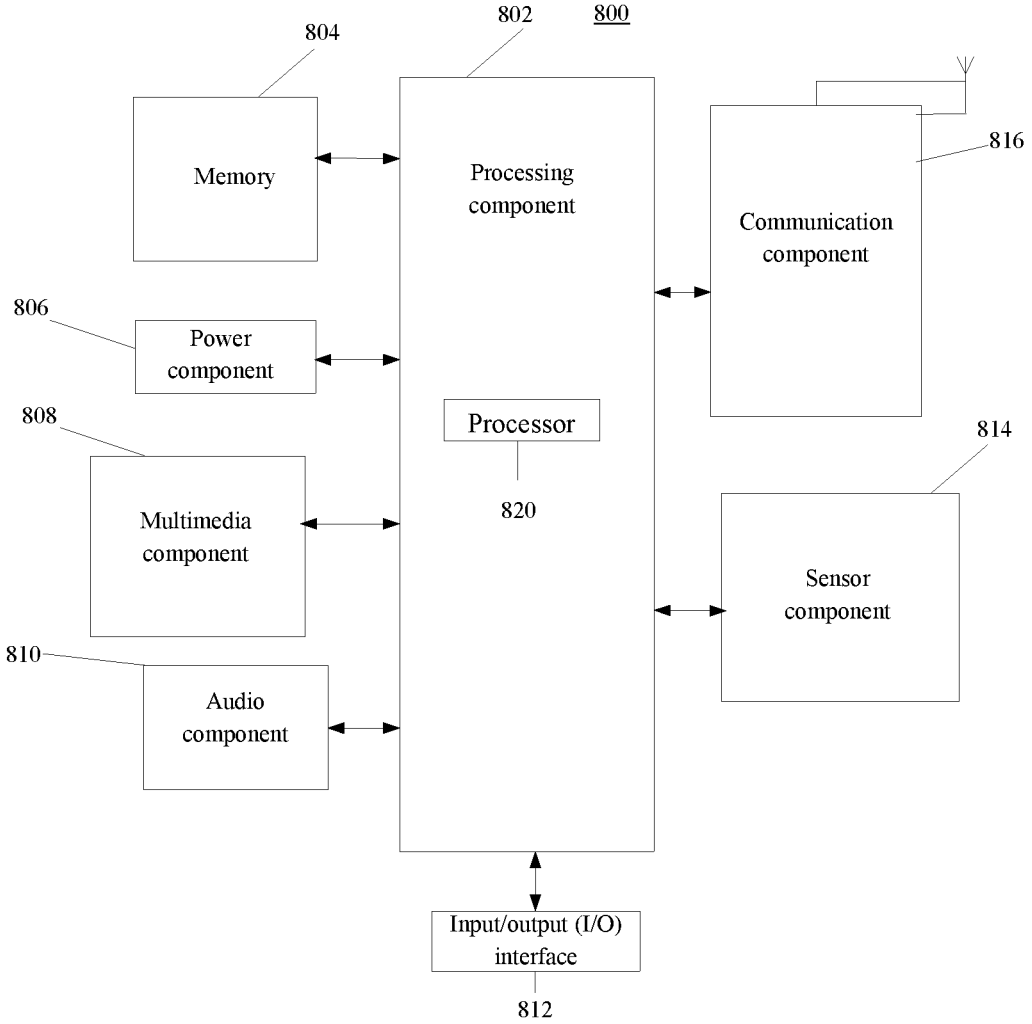
FIG. 8 is a block diagram of a screen display apparatus according to some embodiments.

FIG. 8 is a block diagram of a screen display apparatus 800 according to some embodiments. For example, the apparatus 800 may be a mobile phone, a computer, a digital broadcast terminal, a messaging device, a gaming console, a tablet, a medical device, exercise equipment, a personal digital assistant, and the like.

Referring to FIG. 8, the apparatus 800 may include one or more of the following components: a processing component 802, memory 804, a power component 806, a multimedia component 808, an audio component 810, an input/output (I/O) interface 812, a sensor component 814, and a communication component 816.

The processing component 802 typically controls overall operations of the apparatus 800, such as the operations associated with display, telephone calls, data communications, camera operations, and recording operations. The processing component 802 may include one or more processors 820 to execute instructions to perform all or part of the steps in the above described methods. Moreover, the processing component 802 may include one or more modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the apparatus 800. Examples of such data include instructions for any applications or methods operated on the apparatus 800, contact data, phonebook data, messages, pictures, video, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the apparatus 800. The power component 806 may include a power management system, one or more power sources, and any other components associated with the generation, management, and distribution of power in the apparatus 800.

The multimedia component 808 includes a screen providing an output interface between the apparatus 800 and the user. In some embodiments, the screen may include a liquid crystal display (LCD) and a touch panel (TP). In some embodiments, organic light-emitting diode (OLED) displays can be employed.

If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 808 includes a front camera and/or a rear camera. The front camera and the rear camera may receive an external multimedia datum while the apparatus 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone ("MIC") configured to receive an external audio signal when the apparatus 800 is in an operation mode, such as a call mode, a recording mode, and a voice recognition mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, buttons, and the like. The buttons may include, but are not limited to, a home button, a volume button, a starting button, and a locking button.

The sensor component 814 includes one or more sensors to provide status assessments of various aspects of the apparatus 800. For instance, the sensor component 814 may detect an open/closed status of the apparatus 800, relative positioning of components, e.g., the display and the keypad, of the apparatus 800, a change in position of the apparatus 800 or a component of the apparatus 800, a presence or absence of user contact with the apparatus 800, an orientation or an acceleration/deceleration of the apparatus 800, and a change in temperature of the apparatus 800. The sensor component 814 may include a proximity sensor configured to detect the presence of nearby objects without any physical contact. The sensor component 814 may also include a light sensor, such as a CMOS or CCD image sensor, for use in imaging applications. In some embodiments, the sensor component 814 may also include an accelerometer sensor, a gyroscope sensor, a magnetic sensor, a pressure sensor, or a temperature sensor.

The communication component 816 is configured to facilitate communication, wired or wirelessly, between the apparatus 800 and other devices. The apparatus 800 can access a wireless network based on a communication standard, such as Wi-Fi, 2G, 3G, 4G, 5G or a combination thereof. In some embodiments, the communication component 816 receives a broadcast signal or broadcast associated information from an external broadcast management system via a broadcast channel. In some embodiments, the communication component 816 further includes a near field communication (NFC) module to facilitate short-range communications. For example, the NFC module may be implemented based on a radio frequency identification (RFID)

technology, an infrared data association (IrDA) technology, an ultra-wideband (UWB) technology, a Bluetooth (BT) technology, and other technologies.

In some embodiments, the apparatus 800 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In some embodiments, there is also provided a non-transitory computer-readable storage medium including instructions, such as included in the memory 804, executable by the processor 820 in the apparatus 800, for performing the above-described methods. For example, the non-transitory computer-readable storage medium may be a ROM, a RAM, a CD-ROM, a magnetic tape, a floppy disc, an optical data storage device, and the like.

A non-transitory computer-readable storage medium, when instructions in the storage medium are executed by a processor of a terminal device, enabling the terminal device to perform a screen display method, the method including:

determining an OPR corresponding to an image to be displayed;

acquiring a preset corresponding relationship between an original grayscale value and a target grayscale value under the OPR;

sequentially converting the original grayscale value corresponding to each pixel of the image to be displayed into the corresponding target grayscale value according to the corresponding relationship; and displaying the image to be displayed according to the target grayscale value corresponding to each pixel obtained by the conversion.

In some embodiments, the determining the OPR corresponding to the image to be displayed includes:

detecting the original grayscale value of each pixel in the image to be displayed;

calculating an average grayscale value of the image to be displayed according to the original grayscale value of each pixel in the image to be displayed; and determining the OPR corresponding to the image to be displayed according to the average grayscale value of the image to be displayed.

In some embodiments, the calculating the average grayscale value of the image to be displayed includes:

acquiring a color histogram of the image to be displayed by using a color engine in the mobile terminal; and calculating the average grayscale value of the image to be displayed according to a distribution of the color histogram.

In some embodiments, the acquiring the preset corresponding relationship between the original grayscale value and the target grayscale value under the OPR includes:

acquiring the preset corresponding relationship between the original grayscale value and the target grayscale value when a display screen of the mobile terminal is under the OPR from third-party data information; or acquiring the preset corresponding relationship between the original grayscale value and the target grayscale value when the display screen of the mobile terminal is under the OPR from a set storage location of the mobile terminal.

In some embodiments, the converting the first grayscale corresponding relationships under various OPRs into the second grayscale corresponding relationships includes:

converting the first grayscale corresponding relationships under various OPRs to the second grayscale corresponding relationships by using a preset conversion manner; and the preset conversion manner comprises any one of:

a manner using a preset conversion function;

a manner of converting according to a preset lookup table; and a manner of converting using a preset matrix calculation function.

In some embodiments, the operations or steps can be implemented with hardware, software, or a combination thereof. For example, the determining can be implemented with a determination circuit or module including:

a detection subcircuit, configured to detect the original grayscale value of each pixel in the image to be displayed;

a calculation subcircuit, configured to calculate an average grayscale value of the image to be displayed according to the original grayscale value of each pixel in the image to be displayed; and a determination subcircuit, configured to determine the OPR corresponding to the image to be displayed according to the average grayscale value of the image to be displayed.

In some embodiments, the calculation subcircuit includes:

a first subcircuit, configured to acquire a color histogram of the image to be displayed by using a color engine in the mobile terminal; and a second subcircuit, configured to calculate the average grayscale value of the image to be displayed according to a distribution of the color histogram.

In some embodiments, the acquisition circuit includes:

a first acquisition subcircuit, configured to acquire, from third-party data information, the preset corresponding relationship between the original grayscale value and the target grayscale value when a display screen of the mobile terminal is under the OPR; or a second acquisition subcircuit, configured to acquire, from a set storage location of the mobile terminal, the preset corresponding relationship between the original grayscale value and the target grayscale value when the display screen of the mobile terminal is under the OPR.

In some embodiments, the conversion circuit includes:

a first subcircuit, configured to convert the first grayscale corresponding relationships under various OPRs into the second grayscale corresponding relationships by using a preset conversion manner; and the preset conversion manner comprises any one of:

a manner using a preset conversion function;

a manner of converting according to a preset lookup table; and a manner of converting using a preset matrix calculation function.

Various embodiments of the present disclosure can have one or more of the following advantages.

The target grayscale values corresponding to the pixel grayscale values of the image to be displayed can be determined according to the corresponding relationship between the grayscale value and the gamma value under the current OPR that is acquired in real time, and the image is displayed according to the target grayscale values. In this way, the display screen can control the screen display brightness effect to be consistent in any case.

The various circuits, device components, units, blocks, or portions may have modular configurations, or are composed of discrete components, but nonetheless can be referred to as "units," "modules," or "portions" in general. In other words, the "circuits," "components," "modules," "blocks," "portions," or "units" referred to herein may or may not be in modular forms, and these phrases may be interchangeably used.

It will be understood that the "plurality" in the disclosure means two or more, and other quantifiers are similar. "And/or" describes the relationship of the related objects, indicating that there may be three relationships, for example, A and/or B may indicate three cases: A exists alone, A and B exist simultaneously, and B exists alone. The character "/" generally indicates that the relationship between the contextually relevant objects is a "or" relationship. The singular forms "a," "an," and "the" are also intended to include the plural forms unless the context clearly indicates otherwise.

It will be further understood that although the terms such as "first," "second," and the like are used to describe various information, this information should not be limited by these terms. The terms are only used to distinguish the same type of information from each other, and do not indicate a specific order or importance. In fact, the expressions such as "first," "second" and the like can be used interchangeably. For instance, first information can also be referred to as second information without departing from the scope of the disclosure, and similarly, the second information can also be referred to as the first information.

It will be further understood that although the operations in the embodiments of the present disclosure are described in a specific order in the drawings, it will not be understood as requiring that the operations are performed in the specific order shown or in a serial order, or that perform all the operations shown to acquire the desired result. In certain environments, multitasking and parallel processing may be advantageous.

Those of ordinary skill in the art will understand that the above described modules/units can each be implemented by hardware, or software, or a combination of hardware and software. Those of ordinary skill in the art will also understand that multiple ones of the above described modules/units may be combined as one module/unit, and each of the above described modules/units may be further divided into a plurality of sub-modules/sub-units.

It is to be understood that the terms "lower," "upper," "center," "longitudinal," "transverse," "length," "width," "thickness," "upper," "lower," "front," "back," "left," "right," "vertical," "horizontal," "top," "bottom," "inside," "outside," "clockwise," "counter clockwise," "axial," "radial," "circumferential," "column," "row," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

In the present disclosure, the terms "installed," "connected," "coupled," "fixed" and the like shall be understood broadly, and may be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the present disclosure, a first element being "on," "over," or "below" a second element may indicate direct contact between the first and second elements, without contact, or indirect through an intermediate medium, unless otherwise explicitly stated and defined.

Moreover, a first element being "above," "over," or "at an upper surface of" a second element may indicate that the first element is directly above the second element, or merely that the first element is at a level higher than the second element. The first element "below," "underneath," or "at a lower surface of" the second element may indicate that the first element is directly below the second element, or merely that the first element is at a level lower than the second feature. The first and second elements may or may not be in contact with each other.

In the description of the present disclosure, the terms "one embodiment," "some embodiments," "example," "specific example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

In some embodiments, the control and/or interface software or app can be provided in a form of a non-transitory computer-readable storage medium having instructions stored thereon is further provided. For example, the non-transitory computer-readable storage medium may be a Read-Only Memory (ROM), a Random-Access Memory (RAM), a Compact Disc Read-Only Memory (CD-ROM), a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more modules of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium may be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures. For example, the devices can be controlled remotely through the Internet, on a smart phone, a tablet computer or other types of computers, with a web-based graphic user interface (GUI).

A computer program (also known as a program, software, software application, app, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a mark-up language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode) display, other flexible configuration, or any other monitor for displaying information to the user and a keyboard, a pointing device, e.g., a mouse, trackball, etc., or a touch screen, touch pad, etc., by which the user can provide input to the computer.

Other types of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In an example, a user can speak commands to the audio processing device, to perform various operations.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombinations.

Moreover, although features may be described above as acting in certain combinations and even initially claimed as such, one or more features from a claimed combination can in some cases be excised from the combination, and the claimed combination may be directed to a subcombination or variations of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

What is claimed is:

1. A screen display method, applied to a terminal device, the method comprising:

determining an Open Pixel Ratio (OPR) corresponding to an image to be displayed;

acquiring a preset corresponding relationship between an original grayscale value and a target grayscale value under the OPR;

sequentially converting the original grayscale value corresponding to each pixel of the image to be displayed into the corresponding target grayscale value according to the corresponding relationship; and displaying the image to be displayed according to the target grayscale value corresponding to each pixel obtained by the conversion, wherein the determining the OPR corresponding to the image to be displayed comprises:

detecting the original grayscale value of each pixel in the image to be displayed;

calculating an average grayscale value of the image to be displayed according to the original grayscale value of each pixel in the image to be displayed; and determining the OPR corresponding to the image to be displayed according to the average grayscale value of the image to be displayed, wherein the average grayscale value of the image to be displayed reflects the brightness change of a brightest part and a darkest part of the entire image to be displayed, and is calculated based on a sum of the original grayscale values of all pixels and a number of pixels in the image to be displayed, and the sum is calculated according to the original grayscale value of each pixel in the image to be displayed.

2. The method according to claim 1, wherein the calculating the average grayscale value of the image to be displayed comprises:

acquiring a color histogram of the image to be displayed by using a color engine in the mobile terminal; and calculating the average grayscale value of the image to be displayed according to a distribution of the color histogram.

3. The method according to claim 1, wherein the acquiring the preset corresponding relationship between the original grayscale value and the target grayscale value under the OPR comprises:

acquiring the preset corresponding relationship between the original grayscale value and the target grayscale value when a display screen of the mobile terminal is under the OPR from third-party data information; or acquiring the preset corresponding relationship between the original grayscale value and the target grayscale value when the display screen of the mobile terminal is under the OPR from a set storage location of the mobile terminal.

4. A method for generating grayscale mapping information for screen display, the method comprising:

determining first grayscale corresponding relationships of a display screen under various Open Pixel Ratios (OPRs), wherein the first grayscale corresponding relationship under the OPR represents a corresponding relationship between each original grayscale value and an original gamma value under the OPR;

converting the first grayscale corresponding relationships under various OPRs into second grayscale corresponding relationships respectively according to a preset corresponding relationship between a target gamma value and each original grayscale value, wherein the second grayscale corresponding relationship under the OPR represents a corresponding relationship between the target gamma value and a target grayscale value under the OPR; and generating the corresponding relationships between the original grayscale value and the target grayscale value under various OPRs according to the original grayscale values in the first grayscale corresponding relationships and the target grayscale values in the second grayscale corresponding relationships under various OPRs,.

wherein the OPR corresponding to the image to be displayed is determined by following steps:

detecting the original grayscale value of each pixel in the image to be displayed;

calculating an average grayscale value of the image to be displayed according to the original grayscale value of each pixel in the image to be displayed; and determining the OPR corresponding to the image to be displayed according to the average grayscale value of the image to be displayed, wherein, the average grayscale value of the image to be displayed reflects the brightness change of a brightest part and a darkest part of the entire image to be displayed, and is calculated based on a sum of the original grayscale values of all pixels and a number of pixels in the image to be displayed, and the sum is calculated according to the original grayscale value of each pixel in the image to be displayed.

5. The method according to claim 4, wherein the converting the first grayscale corresponding relationships under various OPRs into the second grayscale corresponding relationships comprises:

converting the first grayscale corresponding relationships under various OPRs into the second grayscale corresponding relationships by using a preset conversion manner; and the preset conversion manner comprises any one of:

a manner using a preset conversion function;

a manner of converting according to a preset lookup table; and a manner of converting using a preset matrix calculation function.

6. A display apparatus, comprising:

a processor; and memory for storing instructions executable by the processor;

wherein the processor is configured to:

detect the original grayscale value of each pixel in the image to be displayed;

calculate an average grayscale value of the image to be displayed according to the original grayscale value of each pixel in the image to be displayed;

determine an Open Pixel Ratio (OPR) corresponding to the image to be displayed according to the average grayscale value of the image to be displayed;

acquire a preset corresponding relationship between an original grayscale value and a target grayscale value under the OPR;

sequentially convert the original grayscale value corresponding to each pixel of the image to be displayed into the corresponding target grayscale value according to the corresponding relationship; and display the image to be displayed according to the target grayscale value corresponding to each pixel obtained by the conversion, wherein the average grayscale value of the image to be displayed reflects the brightness change of a brightest part and a darkest part of the entire image to be displayed, and is calculated based on a sum of the original grayscale values of all pixels and a number of pixels in the image to be displayed, and the sum is calculated according to the original grayscale value of each pixel in the image to be displayed.

7. The apparatus according to claim 6, wherein the processor is further configured to:

acquire a color histogram of the image to be displayed by using a color engine in the mobile terminal; and calculate the average grayscale value of the image to be displayed according to a distribution of the color histogram.

8. The apparatus according to claim 6, wherein the processor is further configured to:

acquire, from third-party data information, the preset corresponding relationship between the original grayscale value and the target grayscale value when a display screen of the mobile terminal is under the OPR; or acquire, from a set storage location of the mobile terminal, the preset corresponding relationship between the original grayscale value and the target grayscale value when the display screen of the mobile terminal is under the OPR.

9. An apparatus for generating grayscale mapping information for screen display, comprising:

a processor; and memory for storing instructions executable by the processor;

wherein the processor is configured to:

determine first grayscale corresponding relationships of a display screen under various Open Pixel Ratios (OPRs), wherein the first grayscale corresponding relationship under the OPR represents a corresponding relationship between each original grayscale value and an original gamma value under the OPR;

convert the first grayscale corresponding relationships under various OPRs into second grayscale corresponding relationships respectively according to a preset corresponding relationship between a target gamma value and each original grayscale value, wherein the second grayscale corresponding relationship under the OPR represents a corresponding relationship between the target gamma value and the target grayscale value under the OPR; and generate the corresponding relationships between the original grayscale value and the target grayscale value under various OPRs according to the original grayscale values in the first grayscale corresponding relationships and the target grayscale values in the second grayscale corresponding relationships under various OPRs, wherein the processor is further configured to:

detect the original grayscale value of each pixel in the image to be displayed;

calculate an average grayscale value of the image to be displayed according to the original grayscale value of each pixel in the image to be displayed; and determine the OPR corresponding to the image to be displayed according to the average grayscale value of the image to be displayed, wherein the average grayscale value of the image to be displayed reflects the brightness change of a brightest part and a darkest part of the entire image to be displayed, and is calculated based on a sum of the original grayscale values of all pixels and a number of pixels in the image to be displayed, and the sum is calculated according to the original grayscale value of each pixel in the image to be displayed.

10. The apparatus according to claim 9, wherein the processor is further configured to:

convert the first grayscale corresponding relationships under various OPRs into the second grayscale corresponding relationships by using a preset conversion manner; and the preset conversion manner comprises any one of:

a manner using a preset conversion function;

a manner of converting according to a preset lookup table; and a manner of converting using a preset matrix calculation function.

11. An electronic apparatus implementing the method of claim 1, comprising an active-matrix organic light-emitting diode (AMOLED) display screen, wherein target grayscale value corresponding to pixel grayscale value of the image to be displayed on the AMOLED display screen are determined according to the corresponding relationship between the grayscale value and a gamma value under the current OPR that is acquired in real time, such that the image is displayed on the AMOLED display screen according to the target grayscale value to thereby facilitate the AMOLED display screen control the screen display brightness effect consistently, wherein the electronic apparatus further comprises one or more processing circuits configured to determine the OPR corresponding to the image to be displayed by:

detecting the original grayscale value of each pixel in the image to be displayed;

calculating an average grayscale value of the image to be displayed according to the original grayscale value of each pixel in the image to be displayed; and determining the OPR corresponding to the image to be displayed according to the average grayscale value of the image to be displayed, wherein the average grayscale value of the image to be displayed reflects the brightness change of a brightest part and a darkest part of the entire image to be displayed, and is calculated based on a sum of the original grayscale values of all pixels and a number of pixels in the image to be displayed, and the sum is calculated according to the original grayscale value of each pixel in the image to be displayed.

12. The electronic apparatus according to claim 11, wherein the calculating the average grayscale value of the image to be displayed comprises:

acquiring a color histogram of the image to be displayed by using a color engine in the mobile terminal; and calculating the average grayscale value of the image to be displayed according to a distribution of the color histogram.

13. The electronic apparatus according to claim 12, wherein the acquiring the preset corresponding relationship between the original grayscale value and the target grayscale value under the OPR comprises:

acquiring the preset corresponding relationship between the original grayscale value and the target grayscale value when a display screen of the mobile terminal is under the OPR from third-party data information; or acquiring the preset corresponding relationship between the original grayscale value and the target grayscale value when the display screen of the mobile terminal is under the OPR from a set storage location of the mobile terminal.

14. The non-transitory computer-readable storage medium according to claim 11, wherein the calculating the average grayscale value of the image to be displayed comprises:

acquiring a color histogram of the image to be displayed by using a color engine in the mobile terminal; and calculating the average grayscale value of the image to be displayed according to a distribution of the color histogram.

15. The non-transitory computer-readable storage medium according to claim 14, wherein the acquiring the preset corresponding relationship between the original grayscale value and the target grayscale value under the OPR comprises:

acquiring the preset corresponding relationship between the original grayscale value and the target grayscale value when a display screen of the mobile terminal is under the OPR from third-party data information; or acquiring the preset corresponding relationship between the original grayscale value and the target grayscale value when the display screen of the mobile terminal is under the OPR from a set storage location of the mobile terminal.

16. A non-transitory computer-readable storage medium having instructions stored thereon for execution by a processing circuit to implement operations of the method according to claim 5, wherein the converting the first grayscale corresponding relationships under various OPRs into the second grayscale corresponding relationships comprises:

converting the first grayscale corresponding relationships under various OPRs into the second grayscale corresponding relationships by using a preset conversion manner including at least one of:

using a preset conversion function;

converting according to a preset lookup table; and converting using a preset matrix calculation function.

* * * * *